United States Patent [19]

Huang

[11] 4,406,206

[45] Sep. 27, 1983

[54] HARMONICA

[76] Inventor: Cham-Ber Huang, 257 Benson Ave., Elmont, N.Y. 11003

[21] Appl. No.: 224,861

[22] Filed: Jan. 14, 1981

[51] Int. Cl.[3] ..... G10D 7/12

[52] U.S. Cl. ..... 84/377

[58] Field of Search ..... 84/377-378

[56] References Cited

U.S. PATENT DOCUMENTS

| | | | |
|---|---|---|---|
| 2,340,333 | 1/1944 | Magnus | 84/377 |
| 2,511,302 | 6/1950 | Stephenson | 84/377 |
| 2,815,693 | 12/1957 | Mast | 84/377 |
| 3,757,025 | 9/1973 | Huang | 84/377 |

*Primary Examiner*—Thomas H. Tarcza

*Attorney, Agent, or Firm*—Blum, Kaplan, Friedman, Silberman & Beran

[57] ABSTRACT

A harmonica has sound producing chambers of varying lengths and volumes formed on opposite sides of the harmonica body in a staggered alternating arrangement along the body length. Body depth exceeds chamber depth, and a transition zone in each chamber expands the cross section to connect with a fully dimensioned mouthpiece opening.

18 Claims, 6 Drawing Figures

HARMONICA

BACKGROUND OF THE INVENTION

This invention relates generally to a harmonica of small size and more particularly to a harmonica of high rigidity and being easy to play. There is a need for a small sized harmonica which is satisfied by harmonicas of the prior art having a compact arrangement of chambers formed in a body. To achieve short length and compactness, chambers have been formed into both sides of the body, with chambers on one side of the body either directly in registry with chambers on the other side of the body or arranged in an alternating pattern. In such a configuration each chamber is formed to a depth generally less than one-half the depth of the body. Conventionally, all chambers extend to one edge surface and the chamber openings serve as a mouthpiece for the input or withdrawal of air which passes over reeds provided in association with the chamber in the known manner. As a consequence of this construction, the mouthpiece openings are reduced in size, having a chamber depth approximately half of the depth of the body. The reduced size of the mouthpiece openings restricts the flow of air to the chambers, whether impressed or drawn through the chambers, and reduces the volume of sound produced by a given size harmonica. Also, the effort required on the part of the performer is increased.

What is needed is a harmonica which is small in size, rigid in construction and having the power and ease of playing similar to a larger harmonica.

SUMMARY OF THE INVENTION

Generally speaking, in accordance with the invention, a small sized harmonica especially suitable for high power output and ease of play is provided. The harmonica has sound producing chambers of various lengths and volume formed on opposite sides of the harmonica body in a staggered, alternating arrangement along the body length. Body depth exceeds the depth of the chambers and a transition zone in each chamber expands the chamber cross section to connect with a fully dimensioned circular mouthpiece opening. The mouthpiece openings are aligned in a continuous row on the front of the harmonica. A reed plate with suitable reeds, and outer covers providing sound chambers with rear openings, complete the harmonica in a conventional manner.

Accordingly, it is an object of this invention to provide an improved harmonica which is easy to play although small in size.

Another object of this invention is to provide an improved harmonica having full-size mouthpiece openings whereby a high level of sound power is easily achieved.

A further object of this invention is to provide an improved harmonica having a rigid body construction although sound chambers are closely spaced.

Still another object of this invention is to provide an improved harmonica having a smooth flow path from the mouthpiece to the body chambers.

Still other objects and advantages of this invention will in part be obvious and will in part be apparent from the specification.

The invention accordingly comprises features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

With reference to the figures, a harmonica 10 in accordance with this invention is comprised of a body 12 having upper and lower planar surfaces 14, 16 respectively and front and rear surfaces 18, 20 respectively.

Figure 1:
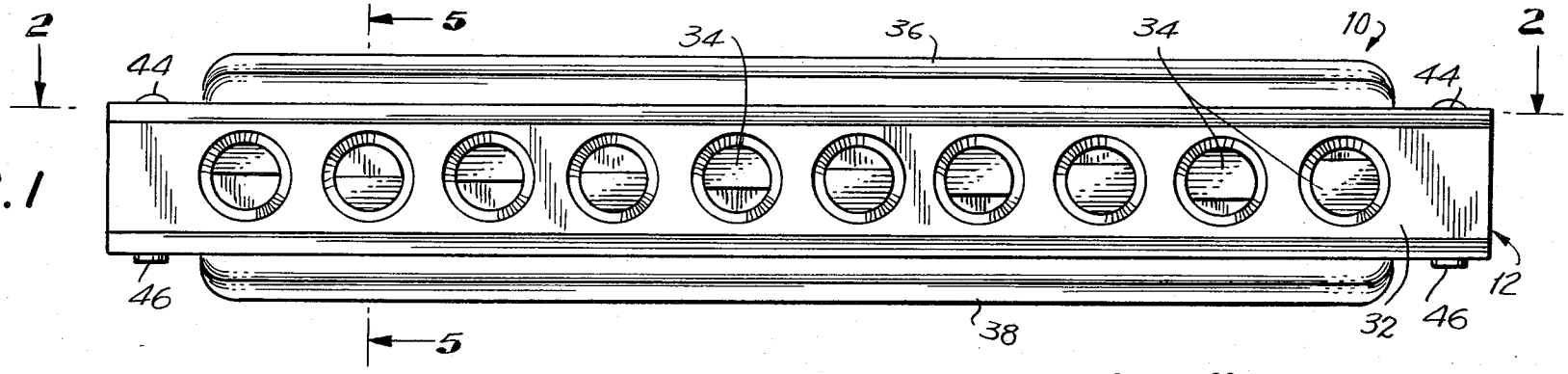
FIG. 1 is a front view of a harmonica in accordance with this invention.
Figure 2:
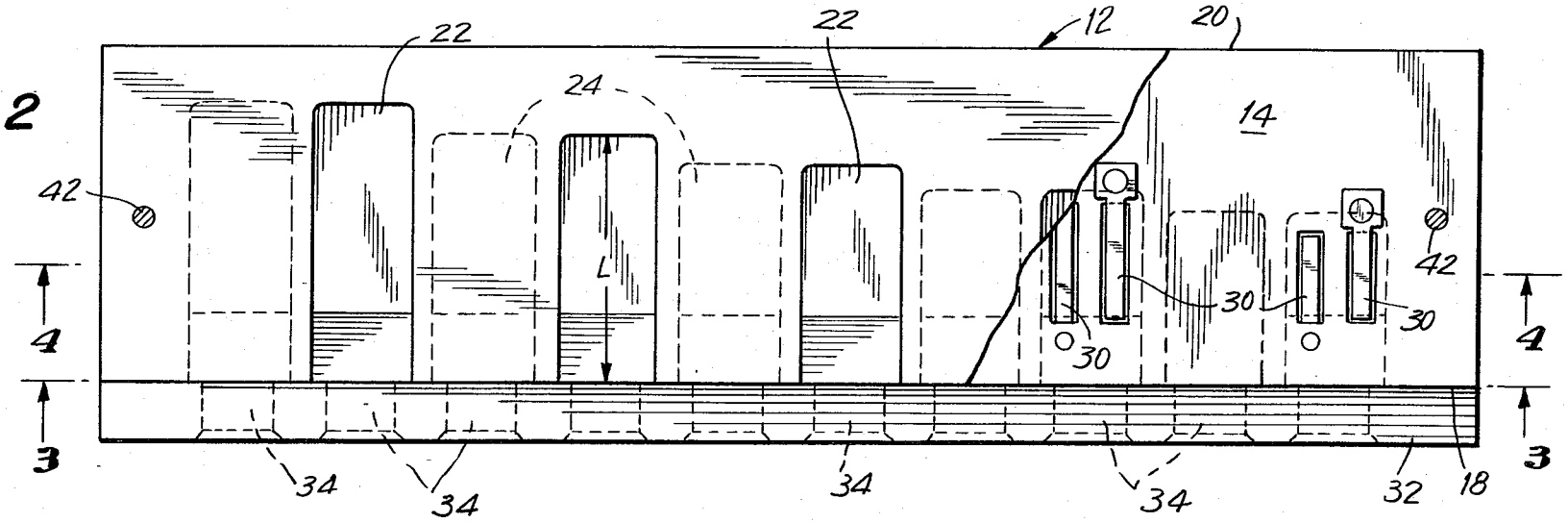
FIG. 2 is a plan view, with a portion cut away, taken along the line 2—2 of FIG. 1.
Figure 3:
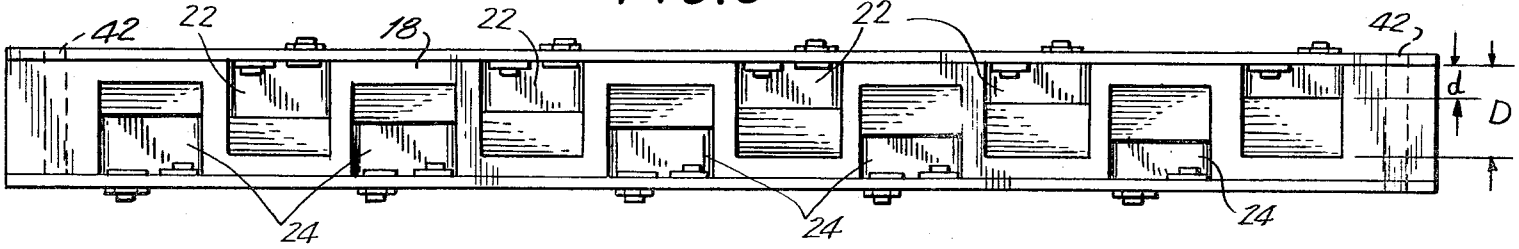
FIG. 3 is a view taken along the line 3—3 of FIG. 2.
Figure 4:
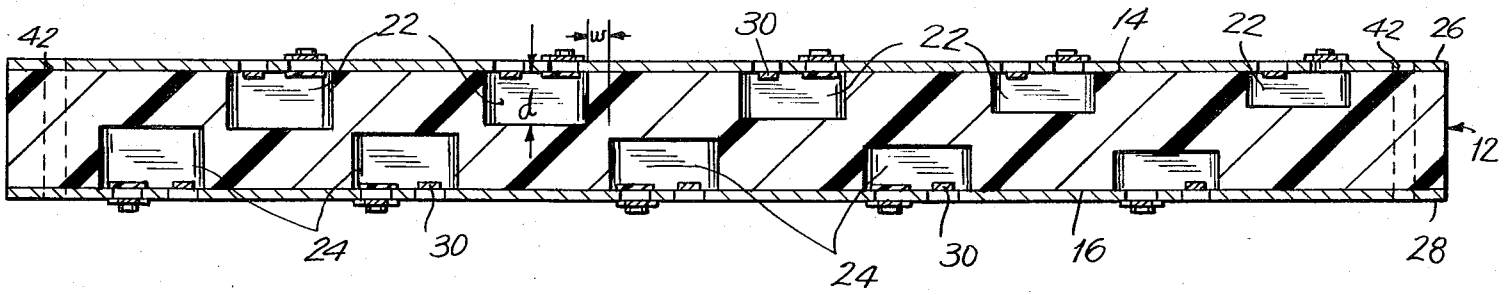
FIG. 4 is a view taken along the line 4—4 of FIG. 2.
Figure 5:
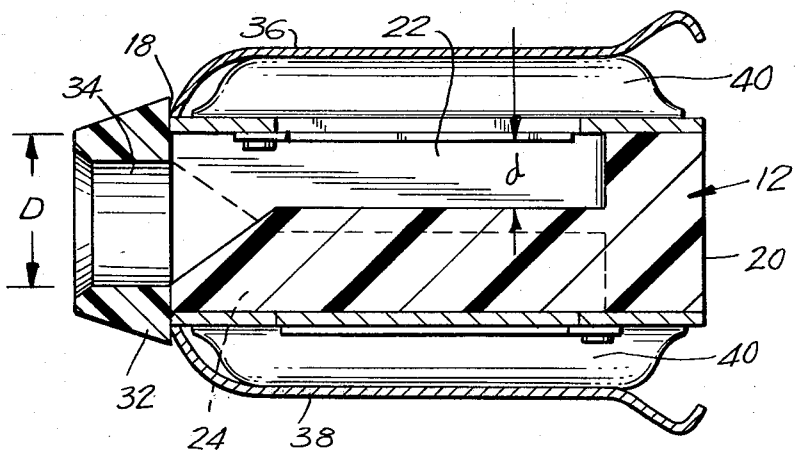
FIG. 5 is a side sectional view taken along the line 5—5 of FIG. 1.

Body chambers or channels 22 are formed into the top surface 14 of the body 12 and body chambers or channels 24 are formed into the lower surface 16 of the body 12. As best seen in FIG. 2, the chambers extend in varying lengths L from the front surface 18 of the body 12. As best seen in FIG. 4, the channels having varying depths d. A transition in the depth of the channel (FIG. 5) enlarges the chamber cross section from the depth d to a depth D at the front surface 18 of the body 12. As shown in FIG. 5, the transition between the two chamber depths d, D is linear although it should be understood that any smooth transition can be used consistent with the musical note to be produced by that chamber as explained more fully hereinafter. The chambers 22, 24 do not extend through the rear surface 20 of the body 12.

As seen in FIG. 4, the body chambers 22,24 are staggered in relation to each other and laterally spaced apart so that a chamber formed in one surface of the body 12 can extend in depth between the chambers fomred in the opposite surface leaving a wall thickness w between them. In this way the thickness of the body 12 can be reduced while at the same time the staggered alternating construction of chambers in the body provides a strong structure having much greater rigidity than a body of similar dimensions wherein all of the body chambers are formed into one planar surface.

The harmonica 10 also comprises upper and lower reed plates 26, 28 respectively which overlay the upper and lower body surfaces 14, 16. The reed plates includes a pair of reeds 30 in registry with each body chamber 22, 24 in the conventional manner. One reed 30 at each body chamber 22, 24 is positioned to produce a musical note when air is forced into the chamber by the performer. A second reed 30 at each chamber is located such that it will produce a note when air is drawn from the chamber by the performer, all in the known manner.

A mouthpiece 32 attaches to the front surface 18 of the body 12 and includes a row of uniformly sized and spaced circular openings which communicate with the chambers 22, 24 in the body 12. It will be apparent that alternate openings 34 communicate with chambers 22 formed in the upper surface 14 of the body 12 while adjacent alternate openings 34 communicate with the chambers 24 formed in the lower surface 16 of the body. As shown in FIG. 5, the mouthpiece openings 34 are sized to register with the enlarged transition zone of the chamber without impediment to flow of air into the chamber. The flow area through a mouthpiece opening 34 is substantially larger than the area which would be available were the transition zone absent between the chamber depth d and the depth D.

The tone produced from any given body chamber and reeds 30 is determined by the length of the reeds and the length and volume of the chamber including the volume of the transitional zone. The volume of the mouthpiece opening 34 in the mouthpiece 32 is also a factor in determining the tone produced when air moves through an opening 34.

The harmonica also includes an upper outer cover 36 and a lower outer cover 38 which are attached to the upper and lower reed plates 26, 28 respectively. In the known manner, the outer covers are contoured to form sound chambers 40 for receiving the air entering and leaving the body chambers 22, 24. The sound chambers 40 open at the rear surface 20 of the harmonica body 12.

Holes 42 at opposite ends of the harmonica 10 pass through the outer covers 36, 38 reed plates 26, 28 and body 12. Machine screws 44 pass through the holes 40 to engage nuts 46 on the opposite side whereby the harmonica 10 is held together with all components in a fixed relationship one to the other.

Figure 6:
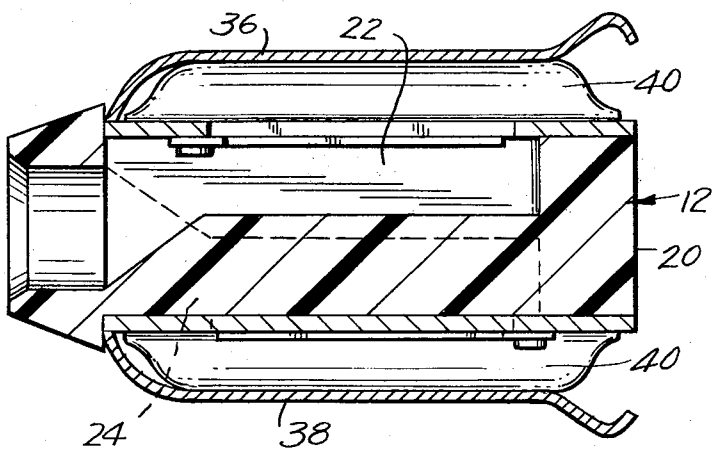
FIG. 6 is a view similar to FIG. 5 of an alternative embodiment of a harmonica in accordance with this invention having an integral mouthpiece and body.

FIGS. 1–5 illustrate an embodiment of a harmonica in accordance with this invention wherein the mouthpiece 32 and body 12 are separate components. It should be understood that in an alternative embodiment of a harmonica in accordance with this invention, the body and mouthpiece are formed (FIG. 6) as an integral member. The body is formed of a rigid material, for example, polycarbonate plastic, the reed plates and reeds are of conventional construction and formed, for example, of brass and bronze; the outer covers may be formed of metal.

Air turbulence is reduced by the smooth transition from the mouthpiece opening 34 to the minimum chamber depth d. The ramp provided by the transition zone in the chamber directs air flow from the mouthpiece toward the reeds 30 when the chambers are pressurized, and similarly assist in providing a smooth flow of air when the performer draws air through the reeds and sound chamber and then to the mouthpiece. Because large inlet openings 34 are provided in spite of the shallow depth d of the body chambers 22, 24 a large attack opening is presented to the performer and the harmonica is much easier to play and is capable of a greater sound volume, as compared to a harmonica which has no transition zone between chambers of depth d and the mouthpiece openings. As stated above, the alternating, staggered arrangement of chambers in the body 12 allows for small size without loss of strength.

It should be understood that in alternative embodiments in accordance with this invention, the openings in the mouthpiece need not be round as illustrated, but may be any suitable shape, for examples, squares, rectangles, oval.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A single row harmonica including:

a body, said body having a plurality of chambers, said chambers being arranged at a first and a second level of said body, said chambers being spaced apart one from the other at each said level, the chambers at said first level being out of registry with the chambers at said second level, each chamber having an opening at, and extending away from a first common surface of said body, said opening at said first common surface substantially spanning the distance between said levels, said body including a first surface at said first level and a second surface at said second level, said first common surface being a portion of said body between said first and second body surfaces, said chambers being formed into said body, extending inwardly from said first and second surfaces, at least one said chamber extending inwardly from one of said first and second body surfaces by a distance which is at least half of the distance between said first and second body surfaces, means located at said first and said second levels for producing a sound when air flows through any said chamber and said associated chamber opening, the means for producing sound for each said chamber being only at the level of the associated chamber.

2. A single row harmonica including:

a body, said body having a plurality of chambers, said chambers being arranged at a first and a second level of said body, said chambers being spaced apart one from the other at each said level, the chambers at said first level being out of registry with the chambers at said second level, each chamber having an opening at, and extending away from a first common surface of said body, said opening at said first common surface substantially spanning the distance between said levels, said body including a first surface at said first level and a second surface at said second level, said first common surface being a portion of said body between said first and second body surfaces, said chambers being formed into said body, extending inwardly from said first and second surfaces, said out of registry positions of said chambers in said first and second surfaces and the width of said chambers allows at least one chamber in said first surface to extend in depth between chambers in said second surface, the depth of each said chamber being independently determined in accordance with the note produced by the chamber, means located at said first and said second levels for producing a sound when air flow through any said chamber and said associated chamber opening, the means for producing sound for each said chamber being only at the level of the associated chamber.

3. A single row harmonica as claimed in claim 2, and further including a mouthpiece, said mouthpiece being connected to said first common surface and having openings extending from a second common surface to said first common surface, each said mouthpiece opening communicating with the opening of one said chamber, each said mouthpiece opening at said first common surface substantially spanning said distance between said levels.

4. A single row harmonica as claimed in claim 3 wherein said openings in said mouthpiece are cylindrical.

5. A single row harmonica as claimed in claim 4, wherein said openings in said mouthpiece are in a single row.

6. A single row harmonica as claimed in claim 5, wherein said mouthpiece openings are aligned and of equal size.

7. A single row harmonica as claimed in claim 3, wherein said mouthpiece openings are in a single row.

8. A single row harmonica as claimed in claim 3, wherein said mouthpiece openings are aligned and of equal size.

9. A single row harmonica as claimed in claim 3, wherein said body and mouthpiece are integral, formed of one piece.

10. A single row harmonica as claimed in claim 1, wherein said chambers have a depth between said first and second levels which is greater at said opening at said first common surface than the depth between said levels at the end of said chamber away from said common surface.

11. A single row harmonica as claimed in claim 10, wherein the transition between said depth at said first common surface and said depth at said end of said chamber is smooth.

12. A single row harmonica as claimed in claim 11, wherein said smooth transition is linear.

13. A single row harmonica as claimed in claim 11, wherein said chambers include at least two portions, a first portion adjacent said first common surface including said transition in depth, and a second portion of constant depth extending from said chamber end to said first portion.

14. A single row harmonica as claimed in claim 1, wherein said means for producing a sound includes a reed plate positioned on each of said first and second body surfaces and closing said chambers except for said openings at said first common surface, said reed plates having apertures therethrough in registry with said chambers, and reeds positioned over said apertures.

15. A single row harmonica as claimed in claim 14, and further comprising an outer cover attached to each said reed plate whereby sound chambers are formed between said outer covers and said reed plates.

16. A single row harmonica as claimed in claim 13, wherein said means for producing a sound includes a reed plate positioned on each of said first and second body surfaces and closing said chambers except for said openings at said first common surface, said reed plates having apertures therethrough in registry with said chambers, and reeds positioned over said apertures.

17. A single row harmonica as claimed in claim 16, and further comprising an outer cover attached to each said reed plate whereby sound chambers are formed between said outer covers and said reed plates.

18. A single row harmonica as claimed in claim 1, wherein said first and second body surfaces are planar and parallel one to the other.

* * * * *